US005819629A

United States Patent [19]

Sarich

[11] Patent Number: 5,819,629

[45] Date of Patent: Oct. 13, 1998

[54] FOOD PROCESSING PRODUCT

[76] Inventor: Richard T. Sarich, 1352 S. 88th St., West Allis, Wis. 53214

[21] Appl. No.: 886,838

[22] Filed: Jul. 1, 1997

Related U.S. Application Data

[63] Continuation of Ser. No. 535,313, Sep. 27, 1995, abandoned, which is a continuation of Ser. No. 251,175, May 31, 1994, abandoned.

[51] Int. Cl.[6] ..... B26B 29/06

[52] U.S. Cl. ..... 83/745; 83/762; 83/932

[58] Field of Search ..... 83/761, 762, 932, 83/743, 745; 269/288, 289 R, 290, 291, 292, 293, 294, 295; 30/289

[56] References Cited

U.S. PATENT DOCUMENTS

| | | | |
|---|---|---|---|
| D. 316,657 | 5/1991 | Mulherin . | |
| 1,764,235 | 6/1930 | Wilmking | 83/762 |
| 2,089,980 | 8/1937 | Owen . | |
| 2,429,756 | 10/1947 | Hartmann | 83/762 |
| 2,918,099 | 12/1959 | Goldstein . | |
| 3,347,296 | 10/1967 | Rothman . | |
| 4,399,989 | 8/1983 | Baillie . | |
| 4,589,206 | 5/1986 | Marcoux . | |
| 4,747,331 | 5/1988 | Policella . | |
| 4,807,505 | 2/1989 | Campbell et al. | 83/762 |
| 4,948,106 | 8/1990 | Popeil et al. . | |
| 5,228,668 | 7/1993 | Guyer . | |
| 5,287,784 | 2/1994 | Brockett . | |
| 5,718,158 | 2/1998 | Rogge | 83/762 |

*Primary Examiner*—Kenneth E. Peterson
*Attorney, Agent, or Firm*—James T. FitzGibbon

[57] ABSTRACT

A combination food article positioning device and slicing guide, primarily intended to assist in slicing buns or bagels. The bun or bagel is entrapped between the guide and a table or other horizontal surface and held in position by contact between an inner end face of a pocket formed in the body of the apparatus and a table or the like. The body also includes sidewall surfaces, some of which are circular portions and others of which taper toward an apex, such that the entire pocket has a "teardrop" configuration. The sidewalls are slotted to receive a knife, and the tapered sidewall segments preferably include serrations or teeth. the noncircular shape opposite the knife-receiving slot and the serrations prevent the food product from turning within the guide.

10 Claims, 1 Drawing Sheet

FOOD PROCESSING PRODUCT

This application is a continuation of application Ser. No, 535,313 filed Sep. 27, 1995, now abandoned, which application was a continuation of Ser. No. 251,179, filed May 31, 1994, now abandoned.

BACKGROUND OF THE INVENTION

The present invention relates generally to a food processing product, and more particularly, to an apparatus for capturing and slicing articles such as bagels, buns, or the like. It is well known that there are a number of food products, particularly including bagels, buns and the like that are primarily intended to be cut into halves so as to expose an outer crust surface and an inner, freshly cut surface. When sliced, such articles may be used to provide sandwiches, or may be used for the purpose of receiving flavored or unflavored spreads, or other food materials such as onions, tomatoes, fish filets, etc. Such bagels and the like are also commonly toasted, and accordingly, require cutting into a reduced thickness in order to be inserted into existing toasters.

One of the problems and slicing of food articles such as a bagel is the inherent difficulty in positioning and retaining the bagel so that it may be sliced with a minimal amount of manipulation and skill by the user. In the past, a number of devices have been proposed for this purpose. Some are intended to slice articles such as bread loaves, which have a considerable transverse extent and which are sliced by repeatedly moving the product or the knife along an axis perpendicular to the cut made during slicing. Others position the food product and provide multiple slots whereby a knife or the like is guided as it makes plural, parallel cuts in the product. Guides used to slice bagels have been of two general types, one wherein the device is open, the bagel inserted and the device closed in the manner of a clam shell; such devices then ordinarily use a precut slot as a knife guide.

Other bagel slicers are of the type with an open top wherein the bagel is positioned for a vertical slicing action with the bagel being inserted through the open top and thereafter being sliced by a knife in the conventional manner.

Prior art bagel slicers, including those described in U.S. Pat. Nos. 2,089,980, 2,918,099, 3,347,296, 4,399,989, 4,589,206, 4,747,331, 4,948,106, 5,228,668, 5,287,784 and Des. Patent No. 316,657, however have all had in common the requirement that the food product be picked up and inserted into the slicing guide or the like, or otherwise manipulated in such a manner that the handling problem are presented, and the time required for the operation is excessive. In commercial operations, such as in restaurants, bakeries, and the like, it is undesirable to require undue handling of food products for obvious sanitary reasons. If gloves are used, the operator is inconvenienced. In addition, the time required to repeatedly handle such products is detrimental to a low cost, high volume food handling operation.

It would be desirable, therefore, if there were an inexpensive article for slicing bagels, buns, or the like that did not require a separate positioning and insertion step whereby the article is positioned within the device.

An ideal product would be one wherein, once positioned in the slicing guide, the act of drawing the knife across the product, either in one direction only, or with a back and forth motion, would not misalign the product or interfere with the slicing as by creating multiple, misaligned cuts or the like.

Ideally, a product could be provided whereby, once an array of bagels or like products were laid on a countertop wherein the slicing were to be accomplished, no more direct handling would be required, especially a separate insertion and/or locking or grasping step.

In view of the failure of the prior art to provide such a food slicing device, therefore, it is an object of the invention to provide an improved slicer for bagels, bakery products, or other articles desired to be cut in half or opened by a single transverse slice.

Another object of the invention is to provide a bagel slicer that does not require a separate insertion or positioning step prior to cutting.

Yet another object of the invention is to provide a bagel slicer that is constructed and arranged so that the cutting operation does not tend to rotate the bagel about an axis transverse to the cutting axis to cause misalignment or unsatisfactory cutting.

A further object of the invention is to provide a bagel slicer or like apparatus whereby the bagel may be captured by the apparatus which is positionable by one hand and thereafter immediately sliced by a knife in the other hand, without requiring additional intermediate or preparatory steps.

A still further object of the invention is to provide a bagel slicer having an open end portion and a cavity or pocket defined by end and side walls surrounding the periphery of the article, with the side walls including a slot extending parallel to and spaced apart from the pocket end face.

The foregoing and other objects and advantages of the invention are achieved in practice by providing a unitary slicing guide having a housing with a closed end wall, an open end opposite the closed end wall and a food article receiving pocket defined by contoured side walls including a curvilinear wall portion and a pair of generally opposed, substantially straight but inclined side wall portions meeting at or approaching an apex within the body, with the side wall being separated into upper and lower elements by a guide slot extending through said body portion.

DESCRIPTION OF THE PREFERRED EMBODIMENTS OF THE INVENTION

While the apparatus of the invention may be embodied in different forms, may be made from different materials, and may vary somewhat from the particular form of apparatus described, a description will be given of a presently preferred form of bagel slicer adapted to receive a single bagel within a contoured pocket having an open bottom, a closed top end and disposed with the open end facing downwardly atop a countertop or like surface and adapted to create a slicing action by the movement of the knife in a horizontal plane. Terms implying orientation, such as "up, down, horizontal", etc. refer to the device in its intended portion of use but are not intended to limit the invention.

Figure 1:
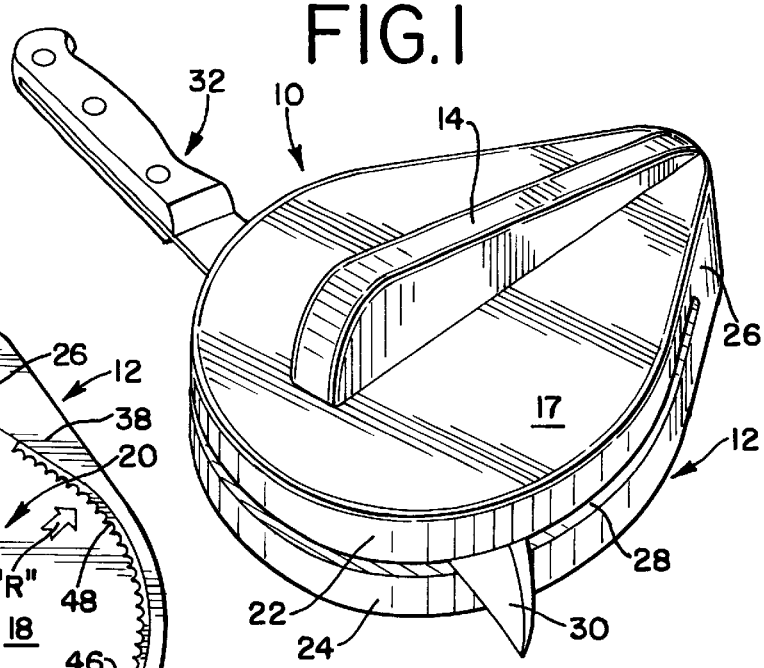
FIG. 1 is a perspective view of the food article capturing and slicing apparatus of the invention, showing the apparatus with the open side down and showing a knife disposed in the slot wherein the food product is being sliced.
Figure 2:
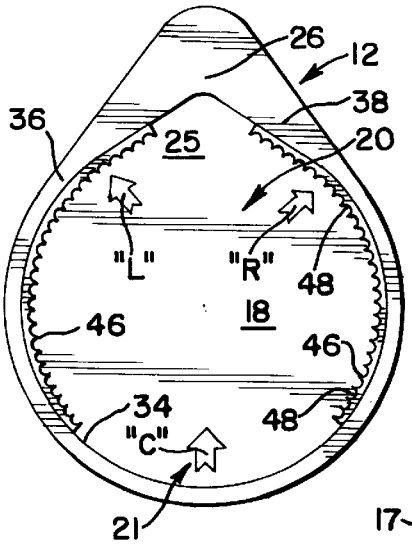
FIG. 2 a bottom plan view of the slicing guide of FIG. 1, showing the open pocket formed by the contoured side walls of the body and the anti-rotation texture of portions of the side walls.
Figure 3:
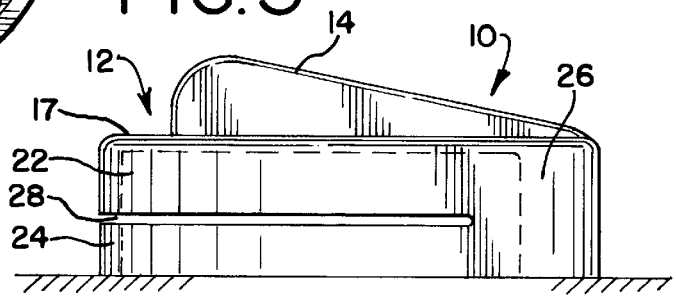
FIG. 3 is a side elevational view of the apparatus of FIGS. 1 and 2.

Referring now to the drawings in greater detail, FIG. 1 shows the slicing guide generally designated 10 to include a body portion generally designated 12 and a grasping handle 14. The body 12 includes an end wall 16 having an upwardly facing exterior surface 17 and a generally planar inner end face surface 18 (FIG. 2). A contoured interior working space or pocket generally designated 20 is defined by the inner end face surface 18 of the end wall 16 and contoured upper and lower side wall segments 22, 24 joined together adjacent an apex portion 25 of the pocket 20. A one-piece end section 26 extends from top to bottom of the body 12, while the upper and lower segments 22, 24 are separated from each other by a slot 28 intended to accommodate the blade portion 30 of a slicing knife generally designated 32.

One important feature of the invention is the shape of the working space or pocket 20 in the slicing guide. As shown, this pocket 20, when viewed in plan (as shown in FIG. 2), includes a curvilinear portion generally designated 21 in which each of the upper and lower side wall segments 34 are formed as portions of a generally circular arc. The pocket also includes an apex portion 25, at or adjacent the point at which a pair of relatively straight wall segments 36, 38 are inclined towards each other and ultimately meet the one-piece portion 26 of the body 12.

As shown in the drawings, the portions or segments 34 of the side walls which are of generally circular arcuate form subtend an angle of from about 180° to about 240° or more. The relatively straight segments 36, 38 are tangent to the curved walls at the end of the arc and extend towards each other to form the apex 25 of the pocket 26. The straight segments 36, 38 have an included angle of about 100°–120° between them, in the form shown.

Figure 4:
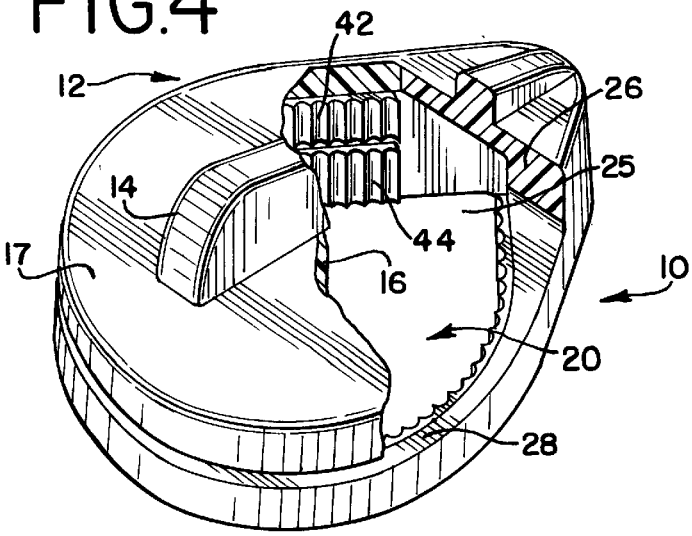
FIG. 4 is perspective view, with portions broken away, similar to that of FIG. 1 but showing the manner in which the pocket is formed with open and closed ends, with side walls having curved and straight wall portions and showing the position of the slicing slot in the device.

As shown in FIGS. 2 and 4, optional anti-rotation means in the form of insert strips 42, 44 are positioned on both the upper and lower segments of the walls along portions of their sides, i.e., throughout a portion of the circular arc and along the major part of the straight wall segments of the pocket 20. The insert strips 42, 44 may be formed from a hard plastic material or the like, and each includes plural peaks or teeth 46 separated by adjacent valleys 48. These surfaces perform a non-destructive but positive gripping function relative to the slicing guide.

Another very significant feature of the invention is the pocket 20 having a completely open end which faces downwardly in use. This enables any one of a plurality of bagels positioned on a countertop or the like to be captured and sliced in an operation which provides the utmost in simplicity.

Referring now to such an operation, and assuming that the guide is grasped by the body 12 or the handle 14 and positioned over a bagel or bun to capture the same, the novel action will be described. With the knife entering the slot from the open end and approximately in the middle of the arcuate side walls, a back-and-forth knife motion is initiated by the user. As shown by the directional arrows in FIG. 2, the arrow "C" shows the application of a compressive force urging one side of the bagel toward the apex 25 of the pocket 20. As the knife begins and continues a back-and-forth motion, the forces include angled components resulting from compressive and transverse loads. These push the bagel toward the flat sections of the side wall sections optionally having the anti-rotation means thereon. These forces combine to prevent rotation of the bagel or like product. Thus, as shown by the left and right directional arrows "L" and "R", the compressive load exerted on the knife forcing the bagel toward the apex 25 is combined with a reactive force resisting the slicing action, thus urging the bagel toward one or the other of the side walls.

By reason of the combination of the gripping action which prevents the bagel from freely rotating about its own axis and the deformation of the bagel into a relatively flat-sided form, the alternate knife strokes readily cut the bagel without permitting it to be rotated.

The combination of arcuate and substantially straight but inclined side walls permits the bagel to be wedged into the side wall apex area without unduly distorting the bagel sides. Normally, one or two knife strokes are all that are required to complete the slicing, it being understood that the slot 28 extends to a point sufficiently close to the pocket apex 25 to permit the knife to cut entirely through the bagel.

When the knife is detected by feel or by contact with the area around the apex as having completed the cutting operation, the slicing guide is simply lifted and placed over another bagel and the operation is repeated. In this manner, there is no need to handle each individual bagel, or insert or to position it at any particular point with respect to the slicing guide. Likewise, the bagel need not be urged toward the apex whereat the side walls join each other except insofar as this force is created by the knife blade. As a consequence, the combination of the open ended pocket and having side walls tapering towards an apex, particularly in combination with the serrated or contoured anti-rotation elements, provides an extremely simple and effective slicing action that, as pointed out above, requires no independent manipulation of the bakery products.

While the illustrated form of pocket shows an angle of perhaps 110° to 120° between the straight line segments of 36 and 38 of the pocket wall, this angle is not particularly critical. However, the angle between the walls must not be so steep that it forms a gradual taper susceptible to inadvertently retaining the bagel or other food product between the surfaces. Thus, if the surfaces contain a slight taper or inclination but are nearly parallel, then a compressive/cutting motion could urge the product into an effectively locked position between the walls, whereby the product would not automatically release from the pocket when this slicing operation was terminated.

Certain prior art devices may have suggested the possibility of providing a locking-type taper to insure that the product does not inadvertently rotate. However, such a taper will create a problem of freely releasing the product, which is an important object of the invention. It is an important object of the invention to provide both a free release of the product and non-rotation. The non-rotation effect should result from the vector forces described above rather than from a pinching or tapered retention of the product between the walls. Accordingly, as used herein and in the claims, the expression "extending towards an apex" is intended to mean walls having an included angle between them of from perhaps 70° or 80° up to about 135° or more.

Referring now to the construction of the product, the body and handle may be made from an easily workable material such as wood or the like. Likewise, the entire body may be made from a plastic material that may be injection molded or otherwise formed in an economical manner indicated by the fact that significant precision is not required.

In the alternative, in the version wherein the body is made from wood or like substance, the anti-rotation elements may be made from a plastic or the like and stapled or clipped into place. In a molded version, such an article made from plastic, such textured surface would presumably be molded into the unit.

The unit as illustrated is shown without an adjustment feature or movable components, and a closed upper end wall. It is anticipated that the end wall could be perforated, or other additional, various non-essential features might be provided if desired. While the side walls defining portions of the open pocket are shown as being continuous, this is not absolutely necessary. Likewise, a pocket apex portion of one particular configuration is shown, although in any area wherein the product never contacts the slicing guide, the configuration of the apex is unimportant.

A handle having opposed gripping edges is shown, but the handle is not strictly necessary as a separate component, nor need any form of holder be provided as long as the slicing guide can readily be gripped without endangering the user. The form of handle illustrated is presently preferred for functional and aesthetic purposes.

Another aspect of the open pocket feature of the invention is that, to the extent that crumbs or the like are generated during slicing, these do not accumulate within the guide, but remain on the table where the slices are handled and wherein clean up easy and does not require significant effort. The absence of retained crumbs is a sanitary advantage also, reducing the likelihood that insects, mice or the like would be attracted to the product between uses. In the above description, using an ordinary knife was suggested, but electric knives or other bladed instruments could also be used.

It will thus be seen that the present invention provides a new and useful food slicing guide having a number of advantages and characteristics including those pointed out and others which are inherent in the invention. A preferred embodiment of the invention having been described by way of example, it is anticipated that variations and modifications to the described form of apparatus will occur to those skilled in the art and that such modifications and changes may be made without departing from the spirit of the invention or the scope of the appended claims.

I claim:

1. A slicing guide for a food product that is of generally circular form in plan, said slicing guide having a body that includes an endwall defining a portion of a food product-receiving pocket, said food product-receiving pocket being further defined by a sidewall extending perpendicular to said endwall about its outer periphery and including a curvilinear wall portion and a portion opposite said curvilinear wall portion including an apex portion, said sidewall including straight wall surfaces which intersect each other to form said apex portion and which wall surfaces join said curvilinear portion, said straight wall surfaces facing a center of said food product-receiving pocket such that said circular food product does not contact any surfaces between said straight wall surfaces, said sidewall being divided into upper and lower portions in use by a slot extending through said curvilinear sidewall portion and toward said apex portion but not entirely through said opposite portion to permit a knife to enter said slot through said curvilinear sidewall and be advanced toward said apex portion to cut substantially entirely through said food product, said pocket endwall in use facing downwardly and entrapping said food product between itself and a horizontal supporting surface.

2. An apparatus as defined in claim 1 wherein said body is made from a wood material.

3. An apparatus as defined in claim 2 wherein said sidewall defining said pocket has attached thereto at least one separately formed textured gripping material in said pocket.

4. An apparatus as defined in claim 3 wherein said gripping material comprises a strip of a plastic material having plural teeth and grooves between said teeth.

5. An apparatus as defined in claim 1 which further includes a handle extending upwardly in use from a top surface of said body.

6. An apparatus as defined in claim 1 wherein said body is made from a molded thermoplastic material.

7. An apparatus as defined in claim 1 wherein each of said straight wall surfaces which taper toward each other further includes anti-rotation means in the form of a serrated surface for engaging the outer periphery of said food product.

8. An apparatus for capturing articles of food on a horizontal work surface and for guiding a knife to slice such articles, said apparatus comprising, in combination, a body portion including an end wall having a downwardly directed inner end face surface defining one portion of a food product-receiving pocket, with the pocket also having an open end opposite said inner end face, said pocket also being defined by radially inwardly directed surfaces of upper and lower side wall segments spaced apart from each other by a narrow guide slot for receiving a knife intended to slice said product, said side wall segments each having a curvilinear inner surface portion defining a rounded portion of straight said pocket and a pair of wall surfaces which face a center of said food receiving pocket, a portion opposite said rounded portion, said opposite portion including an apex portion of said pocket also formed opposite said rounded portion of said pocket, said straight wall surfaces having contact areas that contact a circular food article such that said circular food article does not contact any surfaces between said straight wall surfaces so as to prevent rotation of said food product when an associated knife is moving across said food product and in the direction of said apex portion, said guide slot extending toward but not entirely through said opposite portion.

9. A capturing and slicing guide for food products comprising, in combination, a body portion including an end wall having, in use, a downwardly facing inner end face surface portion defining one portion of a product-receiving pocket, said pocket having an open end opposite said inner end face surface, said pocket also being defined by radially inwardly directed surfaces of a pair of side wall segments closely spaced apart from each other so as to define therebetween a horizontal slot for guidingly receiving a knife for slicing said product, each of said inwardly directed side wall segment surfaces including a substantially circular arcuate portion extending through more than 180°, a portion on said body portion opposite said circular arcuate portion and including an apex portion, said slot extending toward but not entirely through said opposite portion, and a pair of straight portions extending from each of the ends of said arcuate portion toward said apex portion, said straight portions facing a center of said product-receiving pocket, and having contact areas adapted to engage the outer surfaces of a circular food product, such that said circular food product does not contact any surfaces between said straight portions, whereby a circular food product is positioned within said pocket by placing said guide over said product when said product is resting on a flat surface, said food product being able to be sliced without significant rotation into halves by passing a knife through said slot from the arcuate portion of said side wall segment toward said apex with a cutting motion.

10. A capturing and slicing guide as defined in claim 9 which further includes textured anti-rotation means forming a part of each of said straight portions and at least a portion of said arcuate portion.

* * * * *